US005367867A

United States Patent [19]

Lovas et al.

[11] Patent Number: 5,367,867

[45] Date of Patent: Nov. 29, 1994

[54] PROCESS AND APPARATUS FOR CLEANING AN OPEN-END SPINNING ROTOR

[75] Inventors: Kurt Lovas, Bohmfeld; Ulrich Rodiger, Ingolstadt, both of Germany

[73] Assignee: Rieter Ingolstadt Spinnereimaschinenbau AG, Ingolstadt, Germany

[21] Appl. No.: 949,170

[22] Filed: Sep. 22, 1992

[30] Foreign Application Priority Data

Sep. 23, 1991 [DE] Germany ..... 4131666

[51] Int. Cl.[5] ..... D01H 4/24

[52] U.S. Cl. ..... 57/302; 57/304; 57/411

[58] Field of Search ..... 57/302, 304, 406, 407, 57/411

[56] References Cited

U.S. PATENT DOCUMENTS

| | | | |
|---|---|---|---|
| 4,058,963 | 11/1977 | Stahlecker | 57/302 |
| 4,069,654 | 1/1978 | Roehrich | 57/302 |
| 4,166,356 | 9/1979 | Chrtek et al. | 57/302 |
| 4,211,063 | 7/1980 | Bock et al. | 57/304 X |
| 4,265,083 | 5/1981 | Braun et al. | 57/304 X |
| 4,403,472 | 9/1983 | Lattion | 57/302 |
| 4,510,745 | 4/1985 | Kawabata et al. | 57/302 X |

FOREIGN PATENT DOCUMENTS

| | | |
|---|---|---|
| 1560301 | 9/1972 | Germany . |
| 2613180 | 9/1977 | Germany . |

*Primary Examiner*—Joseph J. Hail, III
*Attorney, Agent, or Firm*—Dority & Manning

[57] ABSTRACT

A process for cleaning an open-end spinning rotor which has a fiber collection channel and an open edge, which is covered by a rotor cover. A first compressed-air stream is directed towards the fiber collection channel in a first cleaning phase. Then, in a second cleaning phase, the spacing between the open edge of the spinning rotor and the rotor cover is increased. In addition, a suction air flow leaving the spinning rotor over its open edge is produced. To carry out this process, there is associated with the rotor cover an opening apparatus which is connected, together with at least one blower channel to a common control apparatus. Associated with the rotor cover and with the blower channel, are in each case two working positions, of which the respectively first working position is adopted during the normal spinning operation and in which a compressed-air stream which can be switched on to clean the spinning rotor and which leaves at least one blower channel directed towards the inner surface of the spinning rotor. The respective second working position is set so that the compressed-air stream leaving at least one blower channel either produces an air flow directed from the fiber collection channel towards the open edge of the spinning rotor or is guided away over the open edge of the spinning rotor.

17 Claims, 4 Drawing Sheets

PROCESS AND APPARATUS FOR CLEANING AN OPEN-END SPINNING ROTOR

BACKGROUND OF THE INVENTION

The present invention relates to a process for cleaning an open-end spinning rotor which has a fiber collection channel and an open edge, and which is covered by a rotor cover, in which a suction-air flow, leaving the spinning rotor by way of its open edge, is produced and into which at least one compressed-air stream is guided for cleaning purposes. It also relates to an apparatus for carrying out the process.

It is known to guide a cleaning-air stream through a cleaning channel provided in the rotor cover to the collection channel of the spinning rotor in order thus to loosen the dirt particles adhering in the collection channel of the spinning rotor and then to remove them (DT-AS 1,560,301). It has been shown that perfect cleaning of the collection channel using such an air flow and reliable removal of the fiber ring is not successful.

It is also known, for the purpose of cleaning a spinning rotor, to release the spinning rotor by swinging down a rotor cover and then placing a combined blower and suction apparatus on the rotor housing in sealed manner (DE 2,613,180 A1). Here, however, because the blower tube projects into the spinning rotor there is a risk of a fiber ring in the spinning rotor adhering firmly to this blower nozzle and being unremovable. The cleaning apparatus then requires a separate maintenance step. Moreover, such an apparatus can only be actuated automatically.

SUMMARY OF THE INVENTION

It is the object of the present invention to further develop a generic process and a generic apparatus so that they ensure a high level of efficiency and a high degree operational reliability and, if desired, also enable the manual actuation of an automatic rotor cleaning apparatus.

In accordance with the invention, this object is achieved in that the compressed-air stream is first directed towards the fiber collection channel in a first cleaning phase and then, in a second cleaning phase, the spacing between the open edge of the spinning rotor and the rotor cover is increased. In the first cleaning phase, it is ensured that the compressed-air stream can act on the inner surface of the spinning rotor to its full extent and thus destroy the fiber ring and loosen from the inner wall of the spinning rotor dirt particles which adhere thereto. Then, conditions which are improved by increasing the spacing between the open edge of the spinning rotor and the rotor cover are provided for the fiber ring and loosened fiber pieces and dirt particles to leave the spinning rotor over the open rotor edge in the direction of the suction removal opening. As a result of the increased spacing between the spinning rotor and the rotor cover, this removal does not pose any problems even with small spinning rotors in which the spatial conditions are very restricted.

It is particularly advantageous if removal of the fiber ring from the interior of the rotor is additionally aided pneumatically. To this end, in an advantageous further development of the process according to the invention, in the second cleaning phase the compressed-air stream is guided into the spinning rotor such that an air flow, directed from the fiber collection channel towards the open edge of the spinning rotor is produced.

In an alternative embodiment of the process according to the invention, the compressed-air stream is first directed towards the fiber collection channel in a first cleaning phase and then, in a second cleaning phase, is guided into the spinning rotor so that an air flow is directed from the fiber collection channel towards the open edge of the spinning rotor. Here, it is advantageous if, in the second cleaning phase, the spacing between the open edge of the spinning rotor and the rotor cover is increased.

In order to prevent soiling of the spinning rotor surroundings, it is advantageous if, in the second cleaning phase, the compressed-air stream is blown over the open edge of the spinning rotor substantially in the direction of the suction air flow. This produces a powerful air flow in the direction of the suction air opening, so that there is no risk of soiling the spinning rotor surroundings or the immediate region around the working and spinning point. This is also true if the rotor housing is opened at this time, because this relative movement is not produced by an axial movement of the spinning rotor but by opening the rotor cover.

The cleaning effect and removal of the fiber ring can further be optimized if the first and the second cleaning phases are repeated one or more times. In fact, it has been shown that in some circumstances a fiber ring can get caught during the first cleaning phase on a cover protrusion which projects into the interior of the spinning rotor and receives a blower channel for rotor cleaning. Such a fiber ring is, however, drawn off this cover protrusion when the two cleaning phases are repeated several times and is then reliably removed.

In accordance with the invention, a further optimization is produced, even with very small spinning rotors in which the spatial conditions are extremely restricted, in that following the first or second cleaning phase, a further cleaning phase is provided in which the spacing between the open edge of the spinning rotor and the rotor cover is larger than during the second cleaning phase. As a result of this, the gap between the spinning rotor and the rotor cover is, in all cases, increased to such an extent that a fiber ring cannot be hampered by any element projecting into the interior of the spinning rotor. Here, it is advantageous if the rotor cover largely or completely releases the interior of the spinning rotor in this further cleaning phase.

In a further advantageous manner, it can be provided, in the first cleaning phase, for fibers and dirt particles as well as the fiber ring to be loosened from the fiber collection channel and, in the second cleaning phase, for the fiber ring to be lifted out of the fiber collection channel in order, finally, in a third cleaning phase, to be removed. To this end, all that is necessary is a corresponding orientation of the compressed-air stream and a correspondingly optimum setting of the size of the spacing between the spinning rotor and the rotor cover.

In order to strip a fiber ring which may get caught on a cover protrusion projecting into the interior of the spinning rotor of this protrusion, in a further embodiment of the process according to the invention it can be provided, in the further cleaning phase, for a compressed-air stream directed towards the base of the spinning rotor to be produced on the side remote from the suction air flow. This compressed-air stream then crosses the fiber ring which may become caught and thus strips it from the cover protrusion.

It has been found that dirt particles can be fixed, not only in the region of the fiber collection channel, but also over the entire inner surface of the spinning rotor, in particular also between the fiber collection channel and the open edge of the spinning rotor. Since the fibers are deposited on the surfaces during the spinning process, the adhesion of dirt particles on these surfaces is extremely disadvantageous and prevents the fibers from being deposited on the wall and transferred to the fiber collection channel. It is thus advantageous to provide for cleaning of the spinning rotor too. In accordance with the invention, this cleaning is carried out in such a way that following the second or a third cleaning phase, the previously decelerated spinning rotor is briefly driven again and then decelerated again, and during this deceleration of the spinning rotor the point at which the compressed-air stream acts on the spinning rotor is altered in the longitudinal direction thereof. This change in the point of action is, for example, achieved by changing the spacing between the rotor cover and the spinning rotor.

In order to prevent fiber rings or dirt particles from being able to fall downwards out of the opened housing of the spinning rotor, in an advantageous embodiment of the process according to the invention, it is provided for the suction air flow to be directed substantially in opposition to gravity. In this way, gravity is countered so that the suction air flow has sufficient time to act on dirt particles and the fiber ring in order to remove them.

However, the process according to the invention can be used not only when the spinning rotor is to be cleaned in the conventional way but can also be used advantageously if, to obtain a leading end of a sliver provided for piecing which is always the same, a certain quantity of fibers is previously fed to the spinning rotor, feeding is interrupted for a predetermined period of time and then switched on again for the actual piecing and spinning. For such a case, in accordance with a further advantageous variant of the process according to the invention, it is provided, during the first cleaning phase, for fibers to be temporarily fed to the spinning rotor.

To carry out the process according to the invention, it is provided for there to be associated with the rotor cover an opening apparatus which, together with at least one blower channel, is connected to a common control apparatus, and for there to be associated with the rotor cover and the blower channel, in each case, two working positions. The first working position is adopted during the normal spinning operation and a compressed-air stream, which can be switched on for cleaning the spinning rotor and which leaves the blower channel, is directed towards the inner surface of the spinning rotor, while the second working position is set such that the compressed-air stream leaving the blower channel either produces an air flow directed from the fiber collection channel towards the open edge of the spinning rotor. In the first working position, which is also adopted during the spinning operation and in which the rotor housing is thus closed, the spinning rotor is cleaned, while in the second working position the rotor cover adopts a position with respect to the spinning rotor such that the fiber ring loosened from the fiber collection channel is guided away over the open edge towards the suction air opening.

In this way, it is possible to loosen the dirt particles and the fiber ring from the fiber collection channel in the first relative position of a first blower channel and the spinning rotor and to remove from the spinning rotor the loosened dirt particles and the fiber ring in the second relative position with the aid of a further blower channel. It is possible, in principle, for the blower channels to be arranged outside the rotor cover, but as a rule it is more advantageous to arrange the blower channel, or at least one of them, in the rotor cover.

Advantageously, the blower channel can be brought by a relative movement between the rotor cover and the spinning rotor, from one working position into the other working position relative to the spinning rotor.

To remove the fiber ring, especially in the case of small spinning rotor, it is particularly advantageous if the spacing between the rotor cover and the open edge of the spinning rotor can be altered. This is preferably effected in that the rotor cover is movable with respect to the spinning rotor. In principle, the type of this relative movement is unimportant, but one embodiment of the subject of the invention, in which the rotor cover is mounted to be pivotal about a pivot axis, is particularly advantageous, since, as a result of this pivoting of the rotor cover, the angle of a cover protrusion conventionally provided on the rotor cover is altered with respect to the spinning rotor, which makes it substantially easier to remove the fiber ring.

It has been found that one construction of the apparatus according to the invention is particularly advantageous. In this embodiment the blower channel is oriented substantially transverse with respect to the pivot axis of the rotor cover. As a result of this, optimum flow conditions can be produced in the rotor interior which make it easier to remove the fiber ring.

In order that the detached fiber ring, which is removed from the rotor interior, is immediately subjected to the controlled action of the suction removal flow, in a further embodiment of the invention the connection point of the underpressure source to the housing is substantially perpendicular to the pivot axis of the rotor cover. Here, the connection point of the underpressure source to the housing is, preferably, substantially in the upper region of the housing, since in this way the suction air flow counters gravity. In this way, fiber rings and dirt particles are prevented from escaping from the rotor housing in an uncontrolled way and from being able to contribute to soiling or getting lost in the spinning machine.

In accordance with a further embodiment of the apparatus according to the invention, the blower channel is arranged in the rotor cover so that in its first working position it is directed towards the rotor base and from there towards the fiber collection channel, while in its second working position it is directed towards the fiber collection channel on the side remote from the open edge of the spinning rotor. In this way, with the aid of one and the same blower channel, cleaning of the fiber collection channel is achieved in the first working position, while in the second working position the same blower channel provides for the fiber ring to be moved out of the spinning rotor into the region of action of the suction air flow.

For rapid and reliable removal of the fiber ring and also the dirt particles removed from the rotor interior, it is particularly advantageous if the blower channel is aligned so that the compressed-air stream leaving the blower channel has a flow component which is directed towards the connection point of the underpressure source.

Advantageously, in accordance with the invention there is, apart from a first blower channel directed towards the rotor base or towards the fiber collection channel, a second blower channel which, in its first working position, is directed towards the rotor inner wall between the fiber collection channel and the open edge of the spinning rotor and which, in its second working position, is oriented away over the open edge of the spinning rotor in the direction of the connection point of the underpressure source connected to the housing. Thus, in the first cleaning phase this second blower channel effects cleaning of the rotor wall between the fiber collection channel and the open edge of the spinning rotor, while in its second working position it provides for the fiber ring and the first and fiber particles removed from the rotor interior to be supplied rapidly to the suction air flow.

In order that the rotor cover adopts a defined position with respect to the spinning rotor during the second cleaning phase, so that the blower channels also adopt the desired relative positions with respect to the spinning rotor, it is advantageously provided for there to be associated with the rotor cover a stop which secures it in its second working position. Advantageously, the stop is arranged on a piecing apparatus which can traverse along a plurality of similar working positions each having an open-end spinning rotor.

In order that the rotor speed, which for the cleaning process has to be reduced or even stopped completely, and opening of the rotor cover can be mechanically controlled in a simple way, it is advantageous if the rotor cover is arranged in a covering with which a control lever for controlling a deceleration means of the open-end spinning rotor and an unlocking lever for lifting the rotor cover away from the housing, are associated.

Advantageously, in this case, the control lever is also associated, with respect to its control, with a valve for controlling the supply of compressed air to the blower channel, so that both the rotor deceleration means and the supply of compressed air for rotor cleaning can be controlled by one and the same control lever.

In order that rotor cleaning can be controlled automatically in a simple way, in accordance with a further development according to the invention. Both the control lever and the unlocking lever are controllable by actuating arms which are carried by a piecing apparatus which transverses along a plurality of similar working positions, each having an open-end spinning rotor. Here, advantageously, the actuating arm for the unlocking lever and the stop for the rotor cover (if necessary with a covering placed in between) are movable in synchronism, as a result of which it is ensured, in a simple way, that the stop is always in the correct working position if the rotor cover is unlocked.

The present invention provides the advantage that, although the cleaning action and the removal of the fiber ring are improved, the rotor housing does not have to be fully opened as was necessary in the past to introduce cleaning elements and media. This is the pre-condition for being able to operate the cleaning apparatus both manually and automatically, so that the cleaning procedure, which is automatic in itself, can be triggered as desired and, depending on the working situation, can be triggered both manually and automatically. Moreover, not only is an advantage achieved as regards the operation of the cleaning apparatus, but in addition improvements are achieved as regards the space requirement, since it is not necessary to keep a large space free between the spinning machine and the maintenance apparatus which can traverse along the machine. This space provides for a hood which can be swung down from the working or spinning point.

BRIEF DESCRIPTION OF THE DRAWINGS

Embodiments of the subject of the invention are described below in more detail with the aid of drawings, in which.

DETAILED DESCRIPTION OF THE INVENTION

Figure 1:
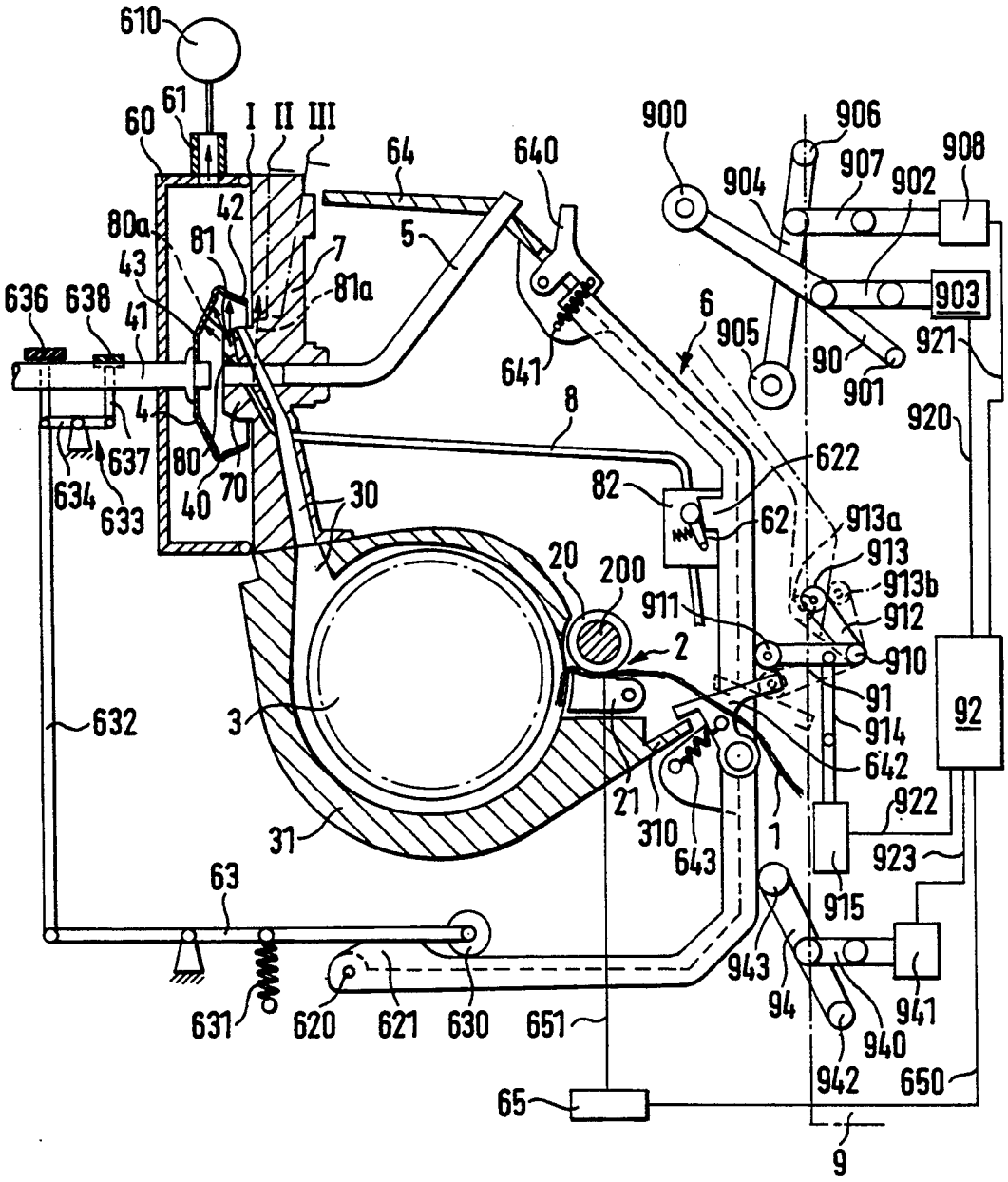
FIG. 1 is a cross-sectional view through an open-end spinning apparatus constructed in accordance with the invention, and a cooperating maintenance apparatus.

The open-end spinning apparatus illustrated in FIG. 1 is represented only schematically, the elements which are not necessary to understand the invention having been omitted.

For supplying a sliver 1 to be spun to an opening roller 3, there is provided a supply apparatus 2. From the opening roller 3, the sliver 1, which has been opened into individual fibers, passes through a fiber feed channel 30 into the interior of a spinning rotor 4, where the fibers are deposited in the form of a fiber ring in a fiber collection channel 40. The fiber ring is continuously taken off with the aid of take-off rollers (not shown) through a thread take-off tube 5 and wound onto a spool (also not shown).

In the embodiment illustrated, the supply apparatus 2 for the sliver 1 has a driven delivery roller 20 which is mounted on a through-going drive shaft 200 and can be controlled individually by means of a coupling (not shown). There cooperates with the deliver roller 20 a feed trough 21 which is borne in known manner pivotally by a housing 31 which supports the opening roller 3.

The spinning rotor 4 is mounted on a shaft 41 in a conventional manner (which is not therefore shown) by support plates or the like and extends through the base of a housing 60 which is connected by way of a suction air connection 61 to an underpressure source 610. The housing 60 is covered by a rotor cover 7 which receives at least part of the fiber feed channel 30 and carries the thread take-off tube 5.

The rotor cover 7 has a cover protrusion 70 which projects into the interior of the spinning rotor 4 and in which the outlet mouth of the fiber feed channel 30 and the inlet mouth of the thread take-off tube 5 are disposed. Moreover, the cover protrusion 70 also has two blower channels 80 and 81 which are connected to a common compressed-air line 8. In the compressed-air line 8 there is a valve 82 which can be controlled by a protrusion 622 of a control lever 62.

The control lever 62 is pivotal about a horizontal axis 620 and has in the vicinity of this axis 620 a switching cam 621. Supported on the control lever 62 in the region of the switching cam 621 is a roll 630 which is arranged at one end of the two-arm lever 63. The lever 63 is acted upon by a tension spring 631 so that the roller 630 always remains in abutment against the control lever 62.

At the end remote from the roller 630, the lever 63 is connected to a switching rod 632 which (for its part) is connected to a linkage 633. In FIG. 1 this linkage 633 is reproduced in a highly simplified form and has, in the embodiment illustrated, a balance lever 634 one end of which is connected by way of a rod 635 to a decelerator means 636 and the other end is connected by way of a rod 637 to a mechanism (not shown) for lifting a drive belt 638 away from the shaft 41 or for placing the drive belt 638 back on the shaft 41.

The elements described thus far are part of an open-end spinning apparatus 6 which is covered by a covering 64. The control lever 62 is arranged in a slot in covering 64 while it is in its shown home position. The covering 64 supports the above-mentioned valve 82. Moreover, the covering 64 also covers and supports the above-mentioned rotor cover 7, so that if the covering 64 is swung down the rotor cover 7 is also removed from the open side of the spinning rotor 4 and the housing 60.

The covering 64 also carries a release lever 640 which, by means of a tension spring 641, holds the control lever 62 in the position shown in opposition to the action of the tension spring 631 which bears on the control lever 63 and acts on the lever 62.

The covering 64 carries a further unlocking or release lever 642 which is acted upon by a tension spring 643 and is thus held in the locked position shown, in which the release lever 642 engages behind a nose 310 of the housing 31. The unlocking or release lever 642 has the task of enabling the rotor cover 7 to be lifted away from the housing 60.

To actuate the release lever 640, an actuating lever or actuating arm 90 is provided which is arranged pivotally on a piecing apparatus 9 which traverses along the open-end spinning apparatus, which has a plurality of similar working stations or spinning points next to one another, each having an open-end spinning apparatus 6. The actuating arm 90, which bears a roll 900 at its free end, is mounted pivotally on an axis 901 and is connected by way of a coupling member 902 to a pivot drive 903.

To return the control lever 62 to its home position in alignment with the covering 64, there is provided on the piecing apparatus 9 a restoring lever 904 with a roll 905 at its free end. The restoring lever 904 is pivoted about an axis 906 and is connected by means of a coupling member 907 to a pivot drive 908.

Similarly, to actuate the release lever 642 there is provided an actuating lever or actuating arm 91 which is pivoted about an axis 910 and carries a roll 911 at its free end. A stop constructed as a stop arm 912 is connected non-positively to actuating arm 91 and, to this end, is mounted on the same shaft 910. This stop arm 912 carries a stop roll 913 at its free end. The actuating arm 91 is connected by way of a coupling member 914 to a pivot drive 915.

To return the covering 64 to its closed position, there is provided on the traversable piecing apparatus 9 a restoring lever 94 which is pivoted about an axis 942 and has a roll 943 at its free end and is connected by way of a coupling member 940 to a pivot drive 941.

The actuating arm 91, with its drive, and the releasing lever 642 together form an opening apparatus for the rotor cover 7, with which at least two working positions (positions I and II) are associated, as will be explained later in more detail. Moreover, the rotor cover 7 can, together with the covering 64, also be brought into a rest position in which the covering 64 is swung down far enough for the open-end spinning apparatus 6 and its sub-assemblies to be accessible.

By way of a respective control lines 920, 921, 922 and 923, the pivot drives 903,908, 915 and 941 are connected to a control apparatus 92 of the piecing apparatus 9 which, in turn, is connected by way of a control line 650 to a control apparatus 65 on the spinning machine side. The control apparatus 65, which controls various functions not explained here, is also in controlled connection, inter alia by way of a control line 651, with the previously mentioned coupling (not shown) of the fiber delivery roller 20.

Now that the construction of the open-end spinning apparatus 6 and the piecing apparatus 9 have been described, the function of these items of apparatus will be described in conjunction with the rotor cleaning which is then followed by conventional piecing.

During the normal spinning process, the sliver is supplied in conventional manner to the spinning rotor 4 after having been opened up into individual fibers, and is incorporated into the end of the thread which leaves the spinning rotor 4 through the thread take-off tube 5. Since, despite all the pre-treatment measures for the fiber material, individual husk particles and other dirt particles cannot be prevented from occasionally passing into the spinning rotor 4, in particular into the fiber collection channel 40, thread breakages repeatedly occur and have to be eliminated. So that such thread breakages are not immediately repeated, the cause thereof has to be eliminated by removing husk particles and the like from the spinning rotor 4. Moreover, in the event of a thread breakage a certain length of the spun thread generally also passes into the interior of the spinning rotor 4 and also has to be removed from the spinning rotor 4, together with a fiber ring in the rotor interior. To this end, cleaning of the spinning rotor 4 is provided for. This is divided into at least two different cleaning phases.

When a thread breakage occurs, a signal is generated by a thread monitor (not shown) and the decoupling of the delivery roller 20 is actuated and thus the supply of sliver to the opening roller 3 interrupted. Moreover, the piecing apparatus 9 is either called to the spinning point concerned with the open-end spinning apparatus 6 which is at a standstill, or it reaches this spinning point anyway on scanning along the machine.

Once the piecing apparatus 9 has stopped at the spinning point at which thread breakage has occurred, the control apparatus 92 of the piecing apparatus 9 actuates the pivot drive 903, which presses the roll 900 of the actuating arm 90 against the release lever 640 and thus releases the control lever 62, which is now pushed out of the above-mentioned slot in the covering 64 in the direction of the piecing apparatus, under the action of the tension spring 631. This means that the control lever 62, by means of its protrusion 622, releases the valve 82, which now, in turn, releases the compressed-air line 8 so that compressed air passes into the blower channels 80 and 81.

At the same time as pivoting of the control lever 62, the drive belt 638 is lifted away from the shaft 41 of the spinning rotor 4 by way of the lever 63, the switching rod 632 and the linkage 633, and the deceleration means or brake 636 is brought to bear against the shaft 41. The spinning rotor 4 is thus decelerated to a standstill or stop. During this deceleration of the spinning rotor 4, the already mentioned compressed air passes through the blower channels 80 and 81 into the interior of the spinning rotor 4 and thus brushes over the entire inner peripheral region of the spinning rotor 4. During this process, the blower channels 80 and 81 are oriented so that they reach the points in the spinning rotor 4 at which the adhesion of dirt particles is particularly frequent. Moreover, the compressed-air streams are oriented so that they are particularly favorable to loosening the fiber ring and dirt particles.

Figure 5:
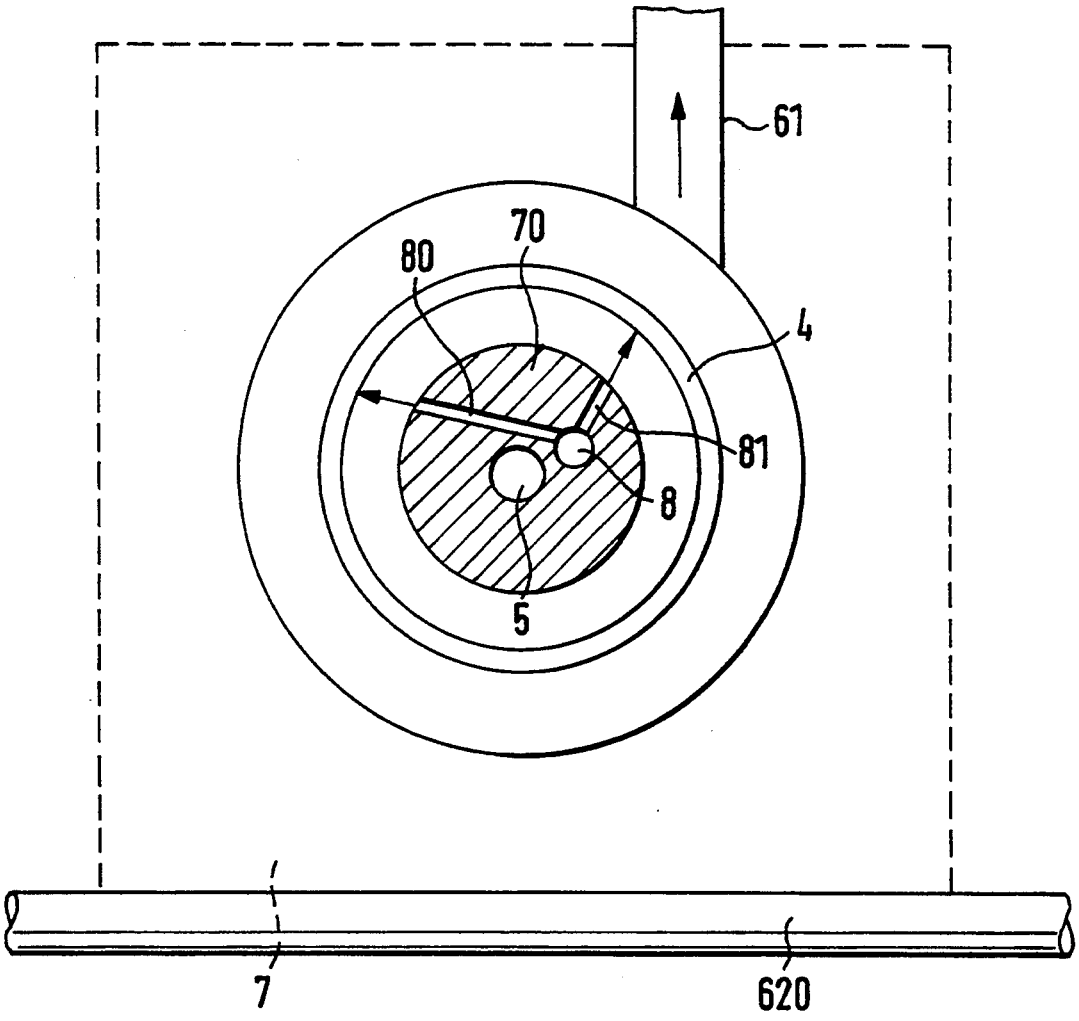
FIG. 5 is a schematic illustration of the air flows in an open-end spinning apparatus.

In accordance with the embodiment shown in FIG. 1, one air flow is guided towards the base 43 of the spinning rotor 4 and from there passes out into the fiber collection channel 40, while the other air flow is guided towards the slide wall between the fiber collection channel 40 and the open edge 42 of the spinning rotor 4, from where the air flow is passed on to the fiber collection channel 40. Moreover, the compressed-air streams which pass through the blower channels 80 and 81 into the rotor interior are orientated in divergent directions (See FIG. 5) so that they exert a tensile action on the fiber ring. Furthermore, the compressed air is introduced in a pulsing manner into the rotor interior so that as a result of this pulsing introduction of the compressed air the cleaning and fiber ring break-up action is optimized.

The first cleaning phase, in which the rotor cover 7 maintains the operating position of the normal spinning operation, namely position I (See FIGS. 1 and 4), is then followed by a second cleaning phase through which the rotor cover 7 is moved away from the housing 60 and, thus, from the open edge 42 of the spinning rotor 4 and brought into a position II. This opening of the rotor cover 7 is controlled by the traversable piecing apparatus 9. To this end, the pivot drive 915 is actuated from the control apparatus 92 and presses the actuating arm 91 against the release lever 642 by means of its roll 911. As a result of this, the releasing lever 643 is unhooked from the nose 310 of the housing 31, whereupon the covering 64 falls as a result of gravity in the direction of the piecing apparatus 9 until the covering 64 comes to bear against the stop roll 913 which now adopts the position 913*a* (see dashed line). This tipping of the cover 64 is effected by the fact that in relation to the axis 620 the entire weight of the covering 64 and the parts connected thereto is arranged on the side of the axis 620 facing the piecing apparatus 9.

With the aid of the stop roll 913, the covering 64 is held in a defined position (position II). This position II is chosen so that the compressed-air stream leaving the blower channel 80 is now directed in the immediate vicinity of the fiber collection channel towards the base 43 of the spinning rotor 4, that is, to say on the side remote from the open edge 42 of the spinning rotor 4, towards the fiber collection channel 40 and passes below the fiber ring there and from there is directed towards the open edge 42 of the spinning rotor 4, so that it lifts the fiber ring out of the fiber collection channel 40 and presses it in the direction of the open edge 42 of the spinning rotor 4.

The stream 81*a* of compressed air which leaves the cover protrusion 70 through the blower channel 81, substantially oriented in the direction of the suction air connection 61, now blows over the open edge 42 of the spinning rotor 4 upwards into the region of action of the suction air flow leaving the housing 60 through the suction air connection 61. This stream 81*a* of compressed air has a flow component which is directed substantially towards the suction air connection 61, i.e. the connection point of the underpressure source 610, and is strong enough for there to be no risk, despite the gap formed between the housing 60 and the rotor cover 70, of dirt particles, fiber fragments or the fiber ring being able to escape in an uncontrolled manner into the surroundings of the housing 60 if the blower channel 81 is not aligned exactly with the suction air connection 61 in the position II of the rotor cover 7.

The combined action of the two flows 80*a* and 81*a* of compressed air have the effect, on the one hand, of reliably loosening and scooping out of the fiber ring and the dirt particles from the fiber collection channel 40 and, on the other hand, of reliably supplying this fiber ring to the suction air flow acting in the suction air connection 61. These compressed-air streams can act continuously or in pulsing manner.

The rotor cleaning is followed, in a manner known per se, by a piecing procedure, so that the spinning process can be continued. It goes without saying that the rotor cleaning can be used in the manner described with every type of piecing, that is to say, both in eliminating thread breakage, in conjunction with a bobbin change, or on starting up the spinning machine after a relatively long stoppage period.

In individual cases, it may happen that the fiber ring cannot be removed from the spinning rotor 4 immediately on the first attempt although it has been detached from the collection channel 40. In fact, in some circumstances the fiber ring may pass to the outer periphery of the cover protrusion 70 and get caught there. In order to reliably transport the fiber ring from the spinning rotor 4 even in such a case, there can be provided (by means of the control apparatus 92 of the traversable piecing apparatus 9) a repeated opening and closing of the rotor cover 7, so that the first and the second cleaning phases are carried out alternately several times. As a result of the movement, in some cases also as a result of the jolt which occurs when the rotor cover 7 meets the housing 60, the fiber ring is detached from the outer surface of the cover protrusion 70 and again passes into the interior of the spinning rotor 4, from where it is conveyed, on the basis of the air flows mentioned, in the direction of the suction air connection 61, the next time the rotor cover 70 is opened.

In principle, this repeated opening and closing of the rotor cover 70 can take place with every cleaning procedure. However, it is also possible to provide with the suction air connection 61 a monitor which responds if the fiber ring passes this monitor and signals to the control apparatus 92 of the piecing apparatus 9, by way of the control apparatus 65 on the machine side and the control line 650, that further opening and closing of the rotor cover 7 is not necessary.

In principle, if repeated opening and closing of the rotor cover is provided, then as a rule two to three repetitions of this procedure is sufficient. If appropriate, an adjustment apparatus by means of which this frequency can be adjusted can be provided with the control apparatus 92.

In some circumstances, it is sufficient to lift the fiber ring out of the fiber collection channel 40 of the spinning rotor 4 by the normal cleaning air flow in the position I of the rotor cover 70 (first cleaning phase), so that by transferring the rotor cover 7 to position II, that is to say by increasing the spacing between the open edge 42 of the spinning rotor 4 and the rotor cover 7, it is ensured that the fiber ring and the dirt particles are reliably removed (second cleaning phase). In this case, it is adequate if a single blower channel 80 is provided which, in the position I of the rotor cover 7, is directed towards the inner wall of the spinning rotor 4 and which (in position II of the rotor cover) blows away over the open edge 42 of the spinning rotor 4 and, thus, cannot provide any air barrier to the fiber ring as it moves out of the spinning rotor 4.

Figure 3:
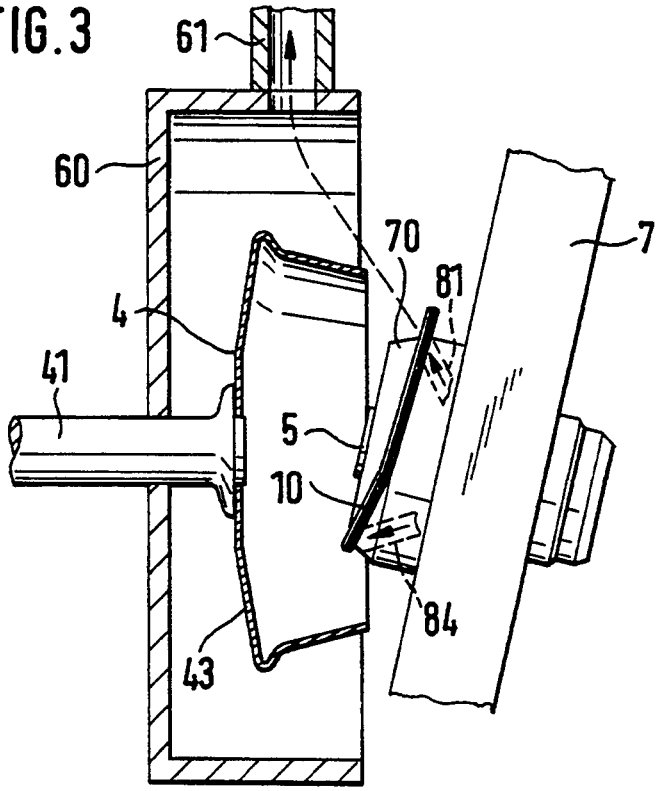
FIG. 3 is a cross-sectional view of a modification to an open-end spinning apparatus according to the invention.

The cover protrusion 70 has a tapered outer surface, so that the transfer of the rotor cover 7 from position I to position II alters the inclination of the cover protrusion 70 such that any fiber ring 10 which has become fixed on the protrusion is helped to slide away (see FIG. 3).

It is also possible to feed fibers to the spinning rotor 4 temporarily during the first cleaning phase. Here, the coupling of the delivery roller 20 (or if necessary another apparatus for interrupting and releasing the fiber feed) is actuated to release the fiber feed when the spinning rotor 4 is decelerated with the aid of the control lever 62. The fiber feed is released in a manner known per se. At the same time as fiber supply is released, the rotor is cleaned so that the fibers are guided out of the spinning rotor 4 again immediately. Then (in a manner known per se) the fiber feed is stopped again. Shortly beforehand, at the same time, or shortly thereafter, the open-end spinning apparatus 6 is switched over to the second cleaning phase.

After the fiber feed has been switched off, and until the actual piecing procedure, in particular until the switching on of the fiber feed, to be carried out at the same time, a defined period of time is maintained, so that a defined tuft for piecing is available, since the tuft alters its condition as a function of time and, thus, also maintains its condition in the same way with the same periods of time.

Since the spinning rotor 4 is decelerated during fiber supply and is then held at a standstill, no fibers can be fixed in the spinning rotor 4, so that rotor cleaning is not impaired, but as a result of the temporary fiber supply to the spinning rotor 4 only, the additional advantage of a tuft condition which is always the same for piecing is achieved.

With certain materials, it is advantageous if the rotor cover 7 is transferred to a position III for guiding away the fiber ring, in which position, the cover protrusion 70 adopts a larger spacing from the spinning rotor 4 than in position II, and, if necessary, is even pivoted completely out of the interior of the spinning rotor 4 and thus completely empties this interior. To this end, the stop roll 913 is brought into the position **913*b***.

Depending on whether the lifting of the fiber ring out of the fiber collection channel 40 is to be aided by a compressed-air stream (compressed-air stream **80*a*), following the first cleaning phase, in which the rotor cover 7 adopts the position I, is either directly a further cleaning phase of this type in which the rotor cover 7 adopts the position III, or, instead, this first cleaning phase is first followed by the second cleaning phase (in which the rotor cover 7 adopts the position II), and then by a further (third) cleaning phase (in which the rotor cover adopts the position III in which the cover protrusion 70 is pivoted largely or even completely out of the rotor interior). Here, in the first cleaning phase fibers, fiber fragments, husk particles and other dirt particles are loosened from the fiber collection channel 40. In the second cleaning phase, the fiber ring is then lifted out of the fiber collection channel and displaced in the direction of the open edge 42 of the spinning rotor 4. In the further, that is, to say, in the third cleaning phase, finally, the fiber ring passes into the suction-air flow and leaves the housing 60 through the suction air connection 61. For this process, a single blower channel 81** is sufficient in some circumstances.

Figure 2:
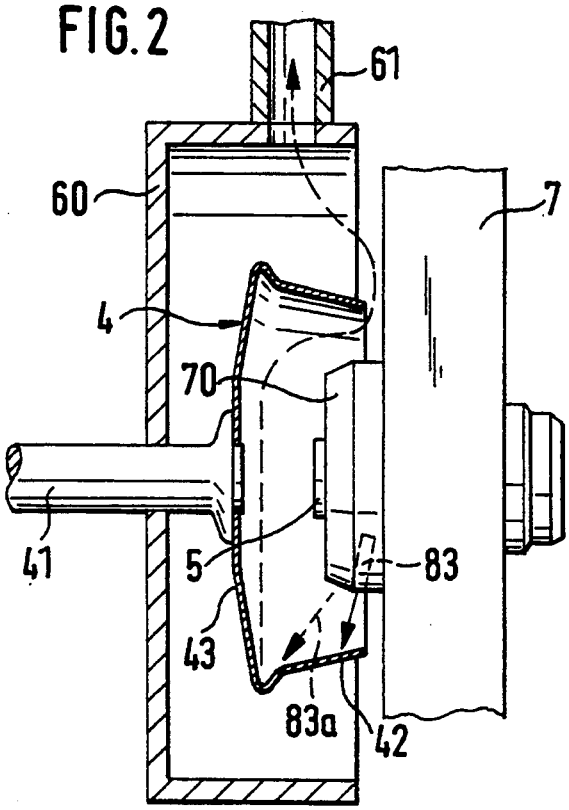
FIG. 2 is a schematic cross-section view through a modified spinning apparatus according to the invention.

The inventive process and, indeed, the inventive apparatus can be modified in various ways, in that the features of the process or apparatus described are replaced by equivalents or are used in other combinations. Thus, it may advantageous if one of the blower channels (blower channel 83) opens into the spinning rotor 4 so that in position I of the rotor cover 7 it opens at a slightly larger spacing from the fiber collection channel 40, while in position II of the rotor cover 7 it supplies a compressed-air stream **83*a* in the vicinity of the fiber collection channel 40 (FIG. 2). This compressed-air stream 83*a* acts on the fiber ring from the side remote from the open edge 42 and pushes the fiber ring to the base 43 of the spinning rotor 4 and from there in the direction of the suction air connection 61**.

It is also possible to provide, additionally or alone, a blower channel 81 (see FIG. 1) which, in the position II of the rotor cover 70, is oriented out over the open edge 42 of the spinning rotor 4 substantially in the direction of the suction air connection 61.

If possible, the two or more blower channels are accommodated in the cover protrusion 70 of the rotor cover 7. In some circumstances, however, the blower channels cannot be accommodated in the cover protrusion 70 of the rotor cover 7 so that they are directed optimally in both positions I and II of the rotor cover 7 for the desired effect. This can be achieved, however, in an alternative way in that (if necessary) the two blower channels are brought into and out of operation as required for one or the other cleaning phase. For example, as a function of the position I or II adopted by the rotor cover 7 or of the movement of the rotor cover 7 into one or the other position I or II. If necessary it is also possible to provide one of the two blower channels independently of the rotor cover 7, as will be explained below with the aid of FIG. 4.

It has been found that it is most advantageous if the suction air channel 61 is arranged in the upper region of the housing 60, since, in this case, the suction air flow acts in opposition to gravity and not in the same direction as gravity. For this reason, the blower channel 81 should also be oriented in opposition to gravity, if possible.

FIG. 3 shows an embodiment in which, in the second or third cleaning phase, that is to say when the rotor cover 7 adopts position II or III, a blower channel 84 is oriented in the cover protrusion 70 on the side remote from the suction air flow removed through the suction air connection 61, towards the base 43 of the spinning rotor 4 in such a way that it crosses the course of any fiber ring 10 which has become caught on the cover protrusion 70 and thus strips it off the cover protrusion 70, so that the compressed-air stream acting in the blower channel 81 can reliably convey the fiber ring 10 into the suction air stream leaving the housing 60 through the suction air connection 61.

The blower channel 84 (FIG. 3), or the blower channels 80 and 81, are if possible oriented substantially transversely with respect to the axis 620 around which the rotor cover 7 is pivoted, since, in this case, an optimum supply to the suction air connection 61 is achieved as described above. In this case, the connection piece 61 also opens substantially perpendicular to this axis 620 into the housing 60.

As mentioned above, when there is a relative movement between the rotor cover 7 and the spinning rotor 4 as a result of at least one compressed-air stream leaving the blower channel arranged in the cover protrusion 70, a relatively large region of the inner wall of the spinning rotor 4 is brushed and cleaned by the air flow. In order to intensify this cleaning effect, it can be provided that, after carrying out at least two cleaning phases, the spinning rotor 4, which was decelerated previously to carry out the first cleaning phase, is driven again briefly and then decelerated again. Driving of the spinning rotor 4 is controlled with the aid of the restoring lever 904 which presses the control lever 62 into the slot in the covering 64. As a result of this action, the deceleration means 636 is lifted away from the shaft 41 of the spinning rotor 4 by way of the lever 63, the switching rod 632 and the linkage 633, the drive belt 638 is brought to bear against the shaft 41 until, as a result of renewed actuation of the actuating arm 90, the release lever 640 again releases the control lever 62, so that the latter is pivoted out of the covering 64, and, thus, again has the effect of lifting the drive belt 638 away from the shaft 41 and placing the deceleration means 636 onto the shaft 41 of the spinning rotor 4.

Matched to this brief driving and renewed stopping of the spinning rotor 4, by moving the actuating arm 91 and the restoring lever 94 the spacing between the rotor cover 7 and the open edge 42 of the spinning rotor 4 is altered, that is to say, the spacing is first increased and is then reduced again, as a result of which the position of the blower channel 80 or of the blower channels 80 and 81 with respect to the spinning rotor 4 is also altered. As a result of this alteration in position relative to the rotor wall, the rotor is also subjected to a cleaning action over its entire surface. When processing particular materials, for example those with a high quantity of brightening agent, this can considerably reduce thread breakage.

The movement of the rotor cover 7 with respect to the spinning rotor 4 is not an unconditional requirement. It is also possible to adjust the spinning rotor 4 axially while keeping the position of the rotor cover 7 unaltered. At least two cleaning phases and correspondingly at least two different rotor positions are thus provided when the rotor cover 7 is closed.

Furthermore, whether this relative movement between the spinning rotor 4 and the rotor cover 7 is a shifting or a pivotal movement does not play a decisive role. For example, the spinning rotor 4 can be displaced axially in the housing 60 in order to provide the conditions present in the embodiment described when the rotor cover 7 is in the position II.

A further possible variant embodiment will be explained below with the aid of FIG. 4. In this case, there is provided in the cover protrusion 70 only a single blower channel 85 which serves to clean the spinning rotor 4 when the open-end spinning apparatus 6 is in its operating position.

Figure 4:
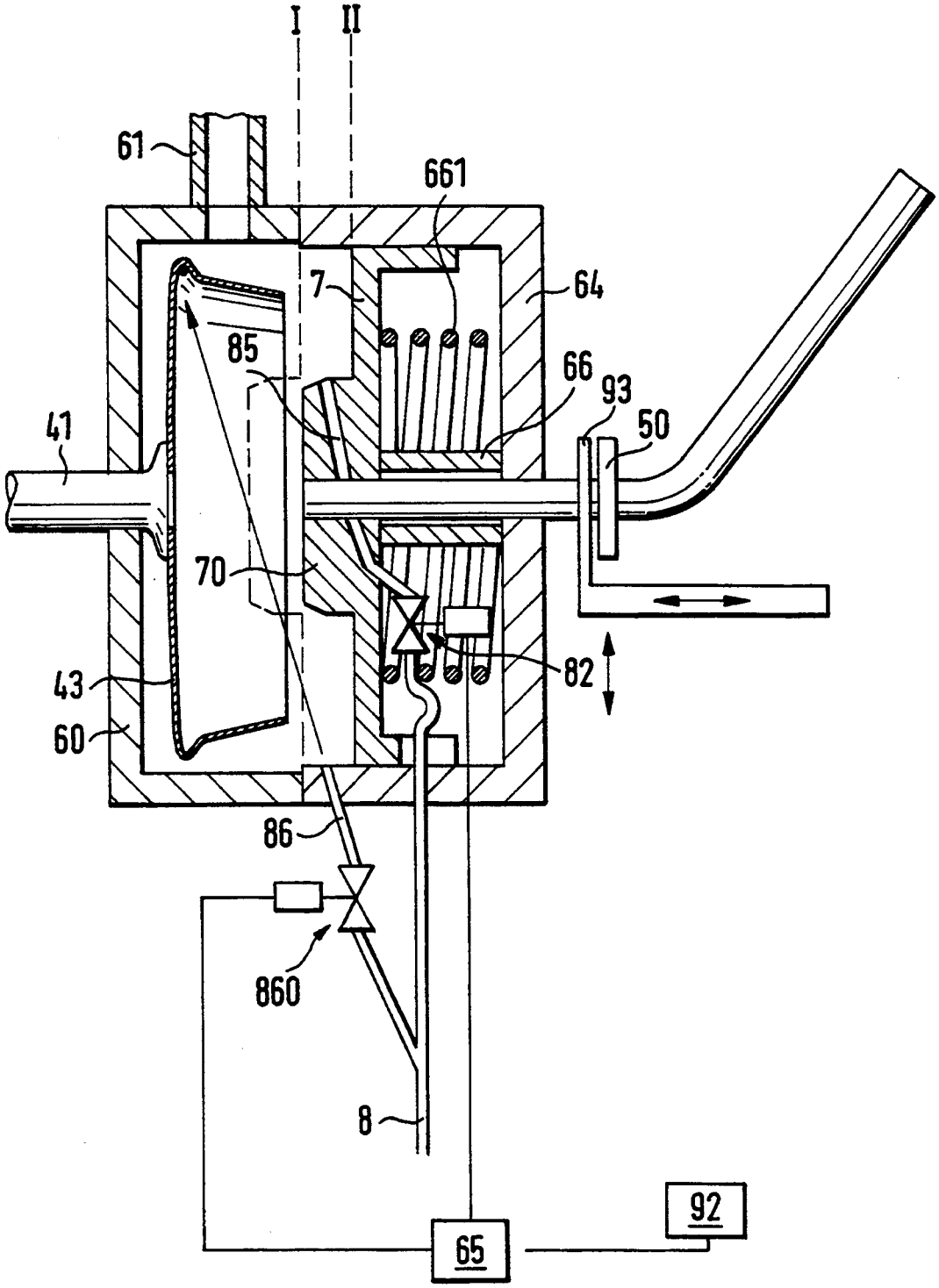
FIG. 4 is a cross-sectional view of another modified embodiment of the open-end spinning apparatus according to the invention.

In the embodiment according to FIG. 4, the rotor cover 7 is not rigidly connected to the covering 64 but is mounted displaceably therein. As a guide, a sleeve 66 is provided in which the thread take-off tube 5 is guided, which for its part is rigidly connected to the rotor cover 7 and has at its end outside the covering 64 a stop ring 50 with which a fork 93 can cooperate.

The fork 93 is mounted on the piecing apparatus 9 and is movable both in the horizontal and in the vertical direction so that it can reach the stop position shown, in which it cooperates with the stop ring 50, and can also be moved out of this stop position again.

The covering 64 has a support plate 66 which also carries the sleeve 66 against which the pressure spring 661 is supported.

In the operating position, which is shown in dashed lines in FIG. 4 (position I), the rotor cover 7 adopts the same position as the rotor cover 7 shown in FIG. 1. In this position of the rotor cover 7, the blower channel 85 is directed towards the inner wall of the spinning rotor 4 in the manner which is optimum for cleaning the spinning rotor 4 in the position I of the rotor cover 7. To transfer the rotor cover 7 to the position II shown, the fork 93 is brought into engagement with the stop ring 50 and drawn in the direction of the piecing apparatus 9 by a defined amount, so that the rotor cover 7 reaches the position II. Here, the valve 82 is closed, if necessary (this depending on the orientation of the blower channel 85). In the housing 60 or indeed in the covering 64 there is provided a further blower channel 86 which during this movement of the rotor cover 7 with respect to the spinning rotor is released. For this purpose a valve 860 is provided which can be controlled, for example, by a switch (not shown) cooperating with the rotor cover 7.

The blower channel 86 is directed into the open-end spinning rotor 4 so that it achieves the optimum lifting action with respect to the fiber ring. To this end, the compressed-air stream emerging from the blower channel 86 is directed, for example, on the side of the spinning rotor 4 remote from the blower channel 86 towards the base 43 of the spinning rotor 4 in the direct vicinity of the fiber collection channel 40, as has already been described in conjunction with FIG. 1 and the blower channel 80. If in this embodiment, it is provided for the rotor cover 7 also to be transferred (within the covering 64) to a position III (not shown in FIG. 4), then the orientation of the compressed-air stream leaving the blower channel 86 remains unaltered, which has an advantageous effect on the removal of the fiber ring.

In the embodiment described with the aid of FIG. 4, the position of the thread take-off tube 5 with respect to the open-end spinning apparatus 6 and also with respect to the take-off rollers (not shown), alters, which can be undesirable. For this reason (if necessary) the thread take-off tube 5 can be constructed to be telescopic, with it being possible for an outer outlet end to remain stationary with respect to the covering 64, regardless of the three positions I, II or III which can be adopted by the rotor cover 7, and for it only to be movable together with the covering 64, while the inner inlet end connected to the rotor cover 7 can be brought into the position I and II and, if appropriate, also into position III by the fork 93.

As FIG. 4 shows, with this embodiment the covering 64 remains in abutment against the housing base of the spinning rotor 4 regardless of whether the rotor cover 7 is in position I, II, or even III, or is moved between these positions. In this way, even when the spacing between the open rotor edge and the rotor cover 7 is increased, a closed space in which the spinning rotor 4 is located remains. Thus, the possibility of fiber ring or dirt particles escaping during cleaning is reliably eliminated, regardless of the arrangement of the suction air connection 61 above or below or the side of the spinning rotor 4. In this embodiment, it is unimportant whether the suction air flow leaves the housing 60 upwards or downwards.

In the embodiments shown, the blower channel or channels are arranged in the rotor cover 7. However, it is also conceivable to provide a blowing air supply in the rotor shaft 41 and, from here, to guide the compressed air into the spinning rotor 4, the relative position of the blower channel being altered in the desired manner by altering the position between the spinning rotor 4 and the blower channel. In this case, the spacing between the spinning rotor 4 and the rotor cover 7 is altered in the manner described by moving the rotor cover 7 and/or the spinning rotor 4.

In the embodiment shown, the control lever 62 is also constructed as a control element for the valve 82 to control the supply of compressed air to the spinning rotor 4. Alternatively, valve 82 can also be controlled in another way, for example electrically from the piecing apparatus 9 or from the control apparatus 92, arranged thereon, by way of the control line 650 and the control apparatus 65 on the machine side.

The actuating arm 91 for the unlocking or release lever 642 is movable in synchronism with the stop constructed as a stop roll 913. In the embodiment described, this is effected by a non-positive connection of these elements by means of a common shaft 910. However, it is also possible to mount the actuating arm 91 and the stop roll 913 independently of one another and to provide them with separate drives which are then, however, controlled synchronously by the control apparatus 92.

We claim:

1. A process for cleaning an open-end spinning rotor which has a fiber collection channel and an open edge which is covered by a rotor cover and which is subject to a suction air flow, comprising the following steps:

a) directing a stream of compressed air into said rotor and into said fiber collection channel in a first cleaning phase to loosen fibers and dirt from the surface of said fiber collection channel;

b) separating said rotor cover from said rotor for a predetermined space which is greater than the space between said rotor and said cover during normal spinning operations of said rotor during a second cleaning phase; and directing said compressed air stream from said fiber collection channel to the open edge of said rotor.

2. A process for cleaning a spinning rotor as set forth in claim 1 including the step of directing said stream of compressed air over the edge of said rotor in the direction of said suction air flow.

3. A process for cleaning a spinning rotor as set forth in claim 1, including the steps of repeating the first and second cleaning phases one or more times.

4. A process for cleaning a spinning rotor as set forth in claim 1, including the step of moving said cover a greater space from said rotor edge than in said second cleaning phase for a third cleaning phase.

5. A process for cleaning a spinning rotor as set forth in claim 4, including the step of uncovering the interior of said rotor during a further cleaning phase.

6. A process for cleaning a spinning rotor as set forth in claim 4, including the steps of loosening fiber and dirt particles during said first cleaning phase, lifting out the fiber ring from said fiber collection channel during said second cleaning phase, and removing said fiber ring from said rotor during said third cleaning phase.

7. A process for cleaning a spinning rotor as set forth in claim 4, including the steps of directing a compressed air stream towards the base of said spinning rotor from a side of said rotor remote from the suction air flow in at least one of said second or third cleaning phases.

8. A process for cleaning a spinning rotor as set forth in claim 1, including the step of directing said suction air flow in opposition to the force of gravity.

9. A process for cleaning a spinning rotor as set forth in claim 1, including the step of feeding fibers to said rotor during said first cleaning phase for a short period of time.

10. A process for cleaning an open-end spinning rotor which has a fiber collection channel and an open-edge which is covered by a rotor cover and which is subject to a suction air flow, comprising the following steps:

a) directing a stream of compressed air into said rotor and into said fiber collection channel in a first cleaning phase to loosen fibers and dirt from within the rotor and any fiber ring from said fiber collection channel;

b) guiding said stream of compressed air into said rotor so that an air flow is generated and directed from the interior of said rotor and said collection channel over the edge of said rotor in a second cleaning phase; and c) increasing the space between said open edge of said rotor cover during said second phase of cleaning said rotor.

11. A process for cleaning a spinning rotor as set forth in claim 10, including the step of moving said cover a greater space from said rotor edge than in said second cleaning phase for a third cleaning phase.

12. A process for cleaning a spinning rotor as set forth in claim 11, including the step of uncovering the interior of said rotor during a further cleaning phase.

13. A process for cleaning a spinning rotor as set forth in claim 11, including the steps of loosening fiber and dirt particles during said first cleaning phase, lifting out the fiber ring from said fiber collection channel during said second cleaning phase, and removing said fiber ring from said rotor during said third cleaning phase.

14. A process for cleaning a spinning rotor as set forth in claim 11, including the steps of directing a compressed air stream towards the base of said spinning rotor from a side of said rotor remote from the suction air flow in at least one of said second or third cleaning phases.

15. A process for cleaning an open-end spinning rotor which has a fiber collection channel and an open edge which is covered by a rotor cover and which is subject to a suction air flow, comprising the following steps:

in a first cleaning phase, directing a stream of compressed air into the fiber collection channel so as to break up any fiber ring and loosen any particles adhering to the inner wall of the spinning rotor; and in a second cleaning phase, directing the compressed air stream to pass over the top of the spinning rotor without entering the spinning rotor so as to cause any loosened fiber ring or particles to be withdrawn from the spinning rotor.

16. A process for cleaning an open-end spinning rotor which has a fiber collection channel and an open edge which is covered by a rotor cover and which is subject to a suction air-flow, comprising the following steps:

directing a stream of compressed air into said rotor and into said fiber collection channel in a first cleaning phase to loosen fibers and dirt from the surface of said fiber collection channel;

separating said rotor cover from said rotor for a predetermined space which is greater than the space between said rotor and said cover during normal spinning operations of said rotor during a second cleaning phase; and stopping said rotor from rotation during one of said first or second cleaning phases and briefly driving said rotor during a third cleaning phase and then stopping its rotation, while moving the point of contact of said compressed air stream on said rotor in the longitudinal direction of said rotor.

17. A process for cleaning an open-end spinning rotor which has a fiber collection channel and an open edge which is covered by a rotor cover and which is subject to a suction air flow, comprising the following steps:

directing a stream of compressed air into said rotor and into said fiber collection channel in a first cleaning phase to loosen fibers and dirt from the surface of said fiber collection channel;

guiding said stream of compressed air into said rotor so that an air flow is directed from said collection channel over the edge of said rotor in a second cleaning phase; and stopping said rotor from rotation during one of said first or second cleaning phases and briefly driving said rotor during a third cleaning phase and then stopping its rotation, while moving the point of contact of said compressed air stream on said rotor in the longitudinal direction of said rotor.

* * * * *